US009783940B2

(12) United States Patent
Luo et al.

(10) Patent No.: US 9,783,940 B2
(45) Date of Patent: Oct. 10, 2017

(54) STRUCTURE AND METHOD OF PAVEMENT ON STEEL DECK BRIDGE

(71) Applicant: SOUTHEAST UNIVERSITY, Nanjing (CN)

(72) Inventors: Sang Luo, Nanjing (CN); Qing Lu, Nanjing (CN); Zhendong Qian, Nanjing (CN); Jianwei Wang, Nanjing (CN); Xinming Wang, Nanjing (CN); Ke Zhong, Nanjing (CN); Jian Zhou, Nanjing (CN); Xu Yang, Nanjing (CN); Xiaohao Wei, Nanjing (CN); Jiahao Tian, Nanjing (CN); Jun Yin, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 15/479,307

(22) Filed: Apr. 5, 2017

(65) Prior Publication Data

US 2017/0204573 A1 Jul. 20, 2017

(51) Int. Cl.
*E01D 19/12* (2006.01)
*E01D 21/00* (2006.01)

(52) U.S. Cl.
CPC ..... *E01D 19/125* (2013.01); *E01D 21/00* (2013.01)

(58) Field of Classification Search
CPC ..... E01D 19/00; E01D 19/08; E01D 19/125; E01D 2101/00; E01C 7/325
USPC ..... 14/73, 74, 77.1; 404/31
See application file for complete search history.

(56) References Cited

U.S. PATENT DOCUMENTS

2003/0215286 A1* 11/2003 Takamura ..... C08L 95/005 404/17
2010/0047015 A1* 2/2010 Takamura ..... E01C 7/353 404/31

FOREIGN PATENT DOCUMENTS

CN 200978385 * 11/2007
CN 103015316 * 3/2013
CN 103981813 * 8/2014

* cited by examiner

*Primary Examiner* — Gary Hartmann
(74) *Attorney, Agent, or Firm* — CBM Patent Consulting, LLC

(57) ABSTRACT

A method for paving a steel bridge deck comprises laying consecutively a 0.6 mm-0.8 mm epoxy waterproofing bond material layer, a 30 mm-40 mm injectable self-flowing asphalt concrete material layer, a 0.4 mm-0.6 mm epoxy asphalt bond material layer, and a 25 mm-40 mm latex cement mortar poured asphalt concrete material layer onto the top of the steel bridge deck to form the steel bridge deck pavement structure.

1 Claim, 1 Drawing Sheet

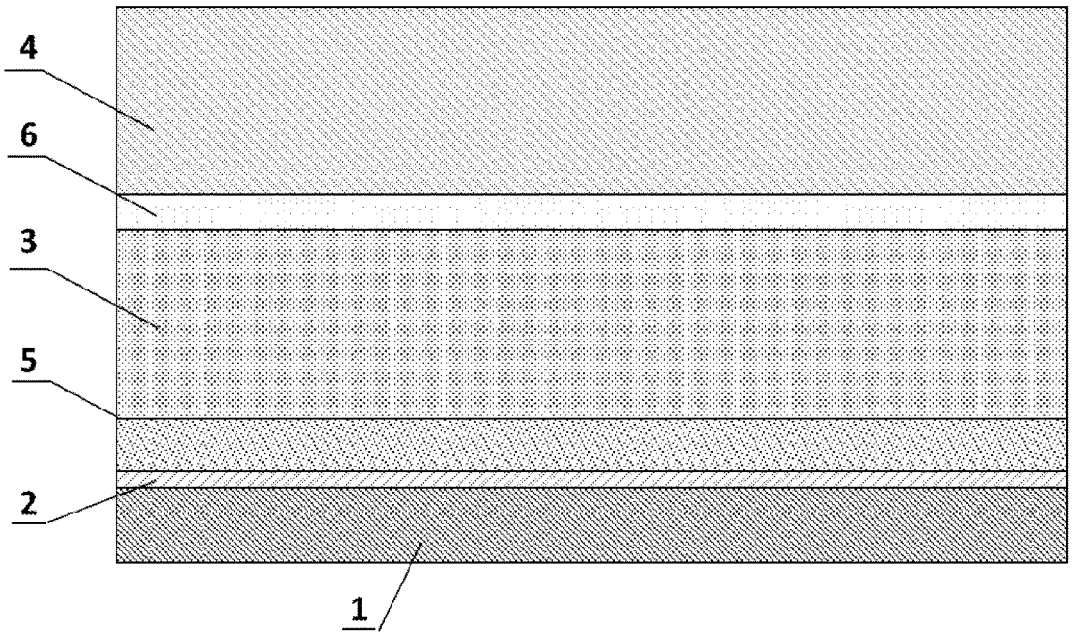
4
6
3
5
2
1

STRUCTURE AND METHOD OF PAVEMENT ON STEEL DECK BRIDGE

TECHNICAL FIELD

The present invention relates to the technical field of road building materials, and more particularly, to a steel bridge deck pavement method and structure for a steel box girder deck.

BACKGROUND

With the continuous improvement of the national road network, the number of constructed channels across rivers is also increasing, wherein steel box girder bridges have been widely constructed as they can span longer distances. However, because the pavement layer laid on the steel box girder deck may experience a bending strain as high as 700 microstrain (the bending strain limit of ordinary road pavement is controlled at <200 microstrain), and the enclosed space of the steel box girder works like an oven in the summer, which makes the steel bridge deck pavement temperature much higher than the temperature of ordinary road pavements, the steel bridge deck pavement layer is prone to cracking, high-temperature rutting and other forms of distress. To resolve these issues, domestic and foreign researchers continue to improve the steel box girder pavement technologies, and have gradually formed the pavement structure patterns of "double layer epoxy asphalt concrete", "lower layer epoxy asphalt concrete+upper layer SMA", "lower layer gussasphalt concrete+upper layer SMA "and" lower layer gussasphalt concrete+upper layer epoxy asphalt concrete".

However, each of the above-mentioned pavement structure patterns has a certain degree of defects, and actual engineering applications also show a variety of pavement defects: (1) for the "double layer epoxy asphalt concrete", since epoxy asphalt concrete is a rigid material that is similar to cement concrete, it is easy to crack, and because dense aggregate gradation is used, its surface texture structure cannot meet desired requirements and may cause vehicle skidding and other traffic hazards; (2) for the "lower layer epoxy asphalt concrete+upper layer SMA", since the high temperature stability of SMA pavement material is poor, it is prone to a upper layer high temperature deformation disease; (3) for the "lower layer gussasphalt concrete+upper layer SMA", since the high temperature performance of the gussasphalt concrete and SMA material is poor, it is prone to high temperature deformation; (4) for the "lower layer gussasphalt concrete+upper layer epoxy asphalt concrete", since the construction processes of gussasphalt concrete and epoxy asphalt concrete are both complicated, which needs to use two different sets of special construction procedures and equipment, its construction cost is high and limits its promotion and application.

Therefore, the development of a steel box girder deck pavement technology that not only prevents the occurrence of pushing and deformation of asphalt concrete under high temperatures and heavy loads, but also ensures that the asphalt concrete can follow the high flexible deformation of steel box girders, and has good surface driving safety features, simple construction process, and cost effectiveness, will quickly promote the application and construction of steel box girder bridges.

SUMMARY

Technical Problems:

The objective of the present invention is to provide a steel deck paving method and structure that not only does not experience pushing and deformation in asphalt concrete under high temperature and heavy load conditions, but also ensures that the asphalt concrete follows the high flexible deformation of steel box girders. The structure has excellent performance in strength, synergistic deformation, low temperature crack resistance, high temperature stability, fatigue, water impermeability, driving comfort, construction convenience, and economy.

Technical Solution:

In order to solve the above-mentioned technical problems, a steel deck pavement structure is provided here. This paving structure consists of, arranged consecutively from bottom to top, an anti-corrosion primer, an epoxy resin waterproof bond material layer, an injectable self-flowing asphalt concrete material layer, an epoxy asphalt bond material layer, a latex cement mortar poured asphalt concrete material layer.

The paving method for the steel bridge deck pavement structure of the present invention comprises:

laying consecutively a 0.6 mm-0.8 mm epoxy waterproofing bond material layer, a 30 mm-40 mm injectable self-flowing asphalt concrete material layer, a 0.4 mm-0.6 mm epoxy asphalt bond material layer, and a 25 mm-40 mm latex cement mortar poured asphalt concrete material layer onto the top of the steel bridge deck to form the steel bridge deck pavement structure; wherein, the epoxy resin waterproof bond material layer is formed by mixing an epoxy resin of 1,6-hexanediol diglycidyl ether with a curing agent containing 2-acrylic acid and 1,3-butadiene polymer, in a weight mixing ratio of 50:50;

injectable self-flowing asphalt concrete material layer is formed by mixing a binder with aggregates, in a weight mixing ratio of 6-0:100; wherein the binder is composed of styrene-butadiene-styrene (SBS) copolymer modified asphalt, thermoplastic rubber, adhesive resin, and plasticizer, in a weight ratio of 100:10:2:1;

the epoxy asphalt bond material layer is composed of an epoxy resin of 1,6-hexanediol diglycidyl ether and a curing agent containing 2-acrylic acid and 1,3-butadiene polymer, in a weight mixing ratio of 50:50;

The latex cement mortar poured asphalt concrete material layer is composed of a macropore open-graded asphalt mixture and a latex cement mortar; wherein the macropore open-graded asphalt mixture is formed by mixing an asphalt binder with aggregates, in a weight mixing ratio of 4-8:100. The air-void content of the macropore open-graded asphalt mixture is 25-35%. The latex cement mortar poured asphalt concrete material layer is composed of a latex modifier, cement, standard sand and water, in a weight mixing ratio of 6:100:20:60. The latex cement mortar is impregnated into the macropore open-graded asphalt mixture through the pores of the macropore-opened asphalt mixture with an air-void content of 25-35%.

Beneficial Effects:

With the above technical proposal, the invention can realize a steel deck pavement structure of "waterproof bond layer+injecting self-flowing asphalt concrete layer+bond layer+latex cement mortar pouring asphalt concrete layer", in which the waterproof bond layer can prevent moisture from intrusion to protect the steel bridge deck and fully adhere to the bridge deck for providing sufficient adhesion to resist the shear stress caused by temperature changes and heavy truck brakes; lower layer injecting self-flowing asphalt concrete can well follow a steel panel deformation with no rutting distress at 70° C., coordinate between the steel bridge panel and the pavement upper layer when in a large deformation, and meanwhile prevent water infiltration due to its near zero air-void content; the bond layer ensures the synergies between the upper and lower pavement layers to collectively carry vehicle loads; as a wearing course, the upper latex cement mortar pouring asphalt concrete has high strength and rutting resistance, sufficient resistance to low temperature bending and fatigue, and will not exhibit high temperature creep deformation when in direct contact with wheel loads.

The invention has improved the overall deformation coordination ability and anti-fatigue performance of the pavement layer, and has acheived a comprehensive balance among the low temperature crack resistance, the high temperature stability performance, and the durability of the structure. The scheme of the invention is a scheme with high performance pavement structure.

BRIEF DESCRIPTION OF THE DRAWINGS

FIG. 1 is a schematic view illustrating the steel bridge deck pavement structure in the present invention.

FIG. 1 has: steel bridge deck 1, anti-corrosion primer 2, injecting self-flowing asphalt concrete layer 3, latex cement mortar pouring asphalt concrete material layer 4, epoxy resin waterproof bond layer 5, epoxy asphalt bond material layer 6.

DETAILED DESCRIPTION

In the paving method of high-performance steel bridge deck pavement according to the present invention, the raw materials are required to satisfy the requirements in Tables 1-5.

TABLE 1

Technical requirements of epoxy resin waterproof bond layer

| technical index | technical requirement | test method |
|---|---|---|
| tensile strength (20° C.)/MPa | ≥5 | GB/T528 |
| elongation at break (20° C.)/% | ≥100 | GB/T528 |
| low temperature flexibility (−20° C.) | no crack | GB/T16777 |
| bonding strength with the steel plate (10 mm/min)/MPa | 25° C., ≥2.75<br>60° C., ≥1.75 | JC/T975 |

TABLE 2

Technical requirements of binder for self-flowing asphalt concrete

| technical index | technical requirement | test method |
|---|---|---|
| penetration (25° C., 5 s) (0.1 mm) | 10-30 | JTJ 052-2000 |
| softening point (R&B) (° C.) | ≥90 | |
| ductility (25° C., 5 cm/min) (cm) | ≥50 | |
| solubility (trichlorethylene) (%) | 85-95 | |
| flash point (° C.) | ≥300 | |
| density (25° C.) (g · cm$^{-3}$) | 1.08-1.23 | |

TABLE 3

Technical requirements of binder for pouring asphalt concrete

| technical index | technical requirement | test method |
|---|---|---|
| penetration (25° C., 5 s) (0.1 mm) | 30-60 | JTJ 052-2000 |
| softening point (R&B) (° C.) | ≥70 | |
| ductility (25° C., 5 cm/min) (cm) | ≥100 | |
| solubility (trichlorethylene) (%) | ≥99.0 | |
| flash point (° C.) | ≥300 | |
| density (25° C.) (g · cm$^{-3}$) | ≥1.00 | |

TABLE 4

Technical requirements of latex cement

| technical index | technical requirement | test method |
|---|---|---|
| solid content (%) | ≥40 | GB 175-2007 |
| viscosity (20° C., MPa · s) | ≥20000 | |
| PH value | 4-6 | |
| particle size (μm) | ≤0.5 | |
| dry compressive shear strength (MPa) | ≥10 | |

TABLE 5

Aggregate gradation requirements of injecting self-flowing asphalt concrete, pouring asphalt concrete, cement mortar mineral

| | percentage passing (%) at each sieve size (mm) | | | | | |
|---|---|---|---|---|---|---|
| pavement material | 13.2 | 9.5 | 4.75 | 2.36 | 0.6 | 0.075 |
| injecting self-flowing asphalt concrete | 100 | 95-100 | 69-74 | 54-65 | 35-48 | 20-30 |
| pouring asphalt concrete | 100 | 100 | 82-100 | 10-18 | 6-14 | 3-9 |
| cement mortar | 100 | 100 | 100 | 100 | 90-100 | 10-20 |

The embodiments of the present invention are described in detail below, but the invention may be embodied in many different forms as defined and covered by the claims.

FIG. 1 shows a high performance steel bridge deck pavement structure of the present invention in which an epoxy resin waterproof bond material layer, an injectable self-flowing asphalt concrete material layer, an epoxy asphalt bond material layer, and a latex cement mortar poured asphalt concrete material layer are arranged consecutively on the steel bridge deck 1.

Among them, the epoxy waterproofing bond material layer has a thickness of 0.6 mm, the injecting self-flowing asphalt concrete material layer has a thickness of 30 mm, the epoxy asphalt bond material layer has a thickness of 0.4 mm, and the latex cement mortar poured asphalt concrete material layer has a thickness of 25 mm.

The epoxy resin waterproof binder is composed of an epoxy resin of 1,6-hexanediol diglycidyl ether and a curing agent containing 2-acrylic acid and 1,3-butadiene polymer, in a mixing ratio of 50:50 by weight.

The injecting self-flowing asphalt concrete in the pavement lower layer is composed of a binder and an aggregate, in a mixing ratio of 8.5:100 by weight. The binder is composed of styrene-butadiene-styrene (SBS) copolymer modified asphalt, thermoplastic rubber, adhesive resin, and plasticizer, in a mixing ratio of 100:10:2:1 by weight.

The epoxy resin waterproof binder is composed of an epoxy resin of 1,6-hexanediol diglycidyl ether and a curing agent containing 2-acrylic acid and 1,3-butadiene polymer, in a mixing ratio of 50:50 by weight.

The latex cement mortar pouring type asphalt concrete in the upper layer of the pavement is composed of a macropore open-graded asphalt mixture and a latex cement mortar; the macropore open-graded asphalt mixture is formed by mixing an asphalt binder and an aggregate, in a mixing ratio of 5.5:100 by weight, and the air-void content of the macropore open-graded asphalt mixture is 30%; the latex cement mortar poured asphalt concrete material layer is composed of a latex modifier, cement, standard sand and water, in a mixing ratio of 6:100:20:60 by weight. The latex cement mortar is impregnated into the macropore open-graded asphalt mixture through the pores of the macropore-opened asphalt mixture with an air-void content of 30%.

In the present embodiment, various technical indexes of the high-performance pavement structure can satisfy the using requirements for the steel bridge deck pavement. Specific test results are shown in Table 6 below:

TABLE 6

| Test results | | | |
|---|---|---|---|
| No. | Item | index test value | technical requirement |
| 1 | Marshall strength | 52.1 kN (latex cement mortar pouring asphalt concrete) | ≥40.4 kN |
| 2 | dynamic stability | 21540 times/mm (70° C., composite structure *) | ≥6000 times/mm |
| 3 | low temperature fracture temperature | −24.4° C. (latex cement mortar pouring asphalt concrete)<br>−21.7° C. (injecting self-flowing asphalt concrete) | ≤−15° C. |
| 4 | low temperature bending strain | $8.9 \times 10^{-3}$ (−15° C., composite structure) | $\geq 8.0 \times 10^{-3}$ |
| 5 | permeability coefficient | 0 ml/min | ≤5 ml/min |
| 6 | bond strength with the waterproof layer | 3.17 MPa (20° C.)<br>1.92 MPa (70° C.) | ≥2.75 MPa (20° C.)<br>≥1.75 MPa (70° C.) |
| 7 | fatigue life | >20 million load repetitions (Composite beam fatigue test, 6 kN, 10 Hz sine wave, load control mode) | >12 million load repetitions |

Among them, for the composite structure, the test specimens used were fabricated based on the structure and layer thickness ratio of the high-performance pavement structure "lower layer injecting self-flowing asphalt concrete+latex cement mortar pouring asphalt concrete" according to the invention.

The foregoing is merely illustrative of the preferred embodiments of the present invention and is not intended to be limiting of the present invention, and various changes and modifications may be made by those skilled in the art. Any modifications, equivalent substitutions, improvements, and the like within the spirit and principles of the invention are intended to be included within the scope of the present invention.

What is claimed is:

1. A method for paving a steel bridge deck pavement structure comprising laying consecutively a 0.6 mm-0.8 mm epoxy waterproofing bond material layer, a 30 mm-40 mm injectable self-flowing asphalt concrete material layer, a 0.4 mm-0.6 mm epoxy asphalt bond material layer, and a 25 mm-40 mm latex cement mortar poured asphalt concrete material layer onto the top of the steel bridge deck to form the steel bridge deck pavement structure; wherein, the epoxy resin waterproof bond material layer is formed by mixing an epoxy resin of 1,6-hexanediol diglycidyl ether with a curing agent containing 2-acrylic acid and 1,3-butadiene polymer, in a weight mixing ratio of 50:50;

the injectable self-flowing asphalt concrete material layer is formed by mixing a binder with an aggregate, in a weight mixing ratio of 6-10:100; wherein the binder is composed of styrene-butadiene-styrene (SBS) copolymer modified asphalt, thermoplastic rubber, adhesive resin, and plasticizer, in a weight ratio of 100:10:2:1;

the epoxy asphalt bond material layer is composed of an epoxy resin of 1,6-hexanediol diglycidyl ether and a curing agent containing 2-acrylic acid and 1,3-butadiene polymer, in a weight mixing ratio of 50:50;

the latex cement mortar poured asphalt concrete material layer is composed of a macropore open-graded asphalt mixture and a latex cement mortar; wherein the macropore open-graded asphalt mixture is formed by mixing an asphalt binder with aggregates, in a weight mixing ratio of 4-8:100, the air-void content of the macropore open-graded asphalt mixture is 25-35%; the latex cement mortar poured asphalt concrete material layer is composed of a latex modifier, cement, standard sand and water, in a weight mixing ratio of 6:100:20:60; the latex cement mortar is impregnated into the macropore open-graded asphalt mixture through the pores of the macropore-opened asphalt mixture with an air-void content of 25~35%.

* * * * *